US008490259B2

(12) United States Patent
Hartgrove et al.

(10) Patent No.: US 8,490,259 B2
(45) Date of Patent: Jul. 23, 2013

(54) DURABLE FLAME-RETARDANT NONWOVEN FABRIC AND METHOD OF MAKING

(75) Inventors: Herbert Hartgrove, Dunn, NC (US); Gregory Rabon, Clayton, NC (US)

(73) Assignee: Polymer Group, Inc., Charlotte, NC (US)

( * ) Notice: Subject to any disclaimer, the term of this patent is extended or adjusted under 35 U.S.C. 154(b) by 815 days.

(21) Appl. No.: 11/913,093

(22) PCT Filed: Aug. 7, 2006

(86) PCT No.: PCT/US2006/030897

§ 371 (c)(1), (2), (4) Date: Sep. 17, 2008

(87) PCT Pub. No.: WO2007/046932

PCT Pub. Date: Apr. 26, 2007

(65) Prior Publication Data

US 2009/0305590 A1 Dec. 10, 2009

Related U.S. Application Data

(60) Provisional application No. 60/705,945, filed on Aug. 5, 2005.

(51) Int. Cl.
*D04H 18/00* (2012.01)
*D04H 1/46* (2012.01)

(52) U.S. Cl.
USPC ..... 28/104; 28/103; 442/136

(58) Field of Classification Search
USPC ..... 264/570; 28/103–104; 442/136, 442/327
See application file for complete search history.

(56) References Cited

U.S. PATENT DOCUMENTS

| | | | | |
|---|---|---|---|---|
| 6,489,256 | B1 | 12/2002 | Kent et al. | |
| 6,491,727 | B1 | 12/2002 | Rearick et al. | |
| 6,596,658 | B1 * | 7/2003 | Putnam et al. | 442/384 |
| 7,125,460 | B2 | 10/2006 | Ogle et al. | |
| 7,259,117 | B2 * | 8/2007 | Mater et al. | 442/414 |
| 2006/0035555 | A1 * | 2/2006 | Narayanan et al. | 442/387 |

FOREIGN PATENT DOCUMENTS

WO 2007/046932 A1 4/2007

OTHER PUBLICATIONS

PCT International Preliminary Report on Patentability, Int'l Appln. No. PCT/US2006/030897, Feb. 5, 2008, 4 pages.
PCT Written Opinion of The International Searching Authority, Int'l Appln. No. PCT/US2006/030897, Nov. 10, 2006, 3 pages.

* cited by examiner

*Primary Examiner* — Lynda Salvatore
(74) *Attorney, Agent, or Firm* — Kilyk & Bowersox, P.L.L.C.; Valerie Calloway

(57) ABSTRACT

This invention relates to a durable fire retardant nonwoven fabric and method of making the same. Said fabric performs in accordance to the requirements set forth in Technical Bulletin 603 of the State of California Department of Consumer Affairs (TB_603), wherein the fire retardant fabric includes at least two layers including at least one strength and reinforcing layer.

16 Claims, 1 Drawing Sheet

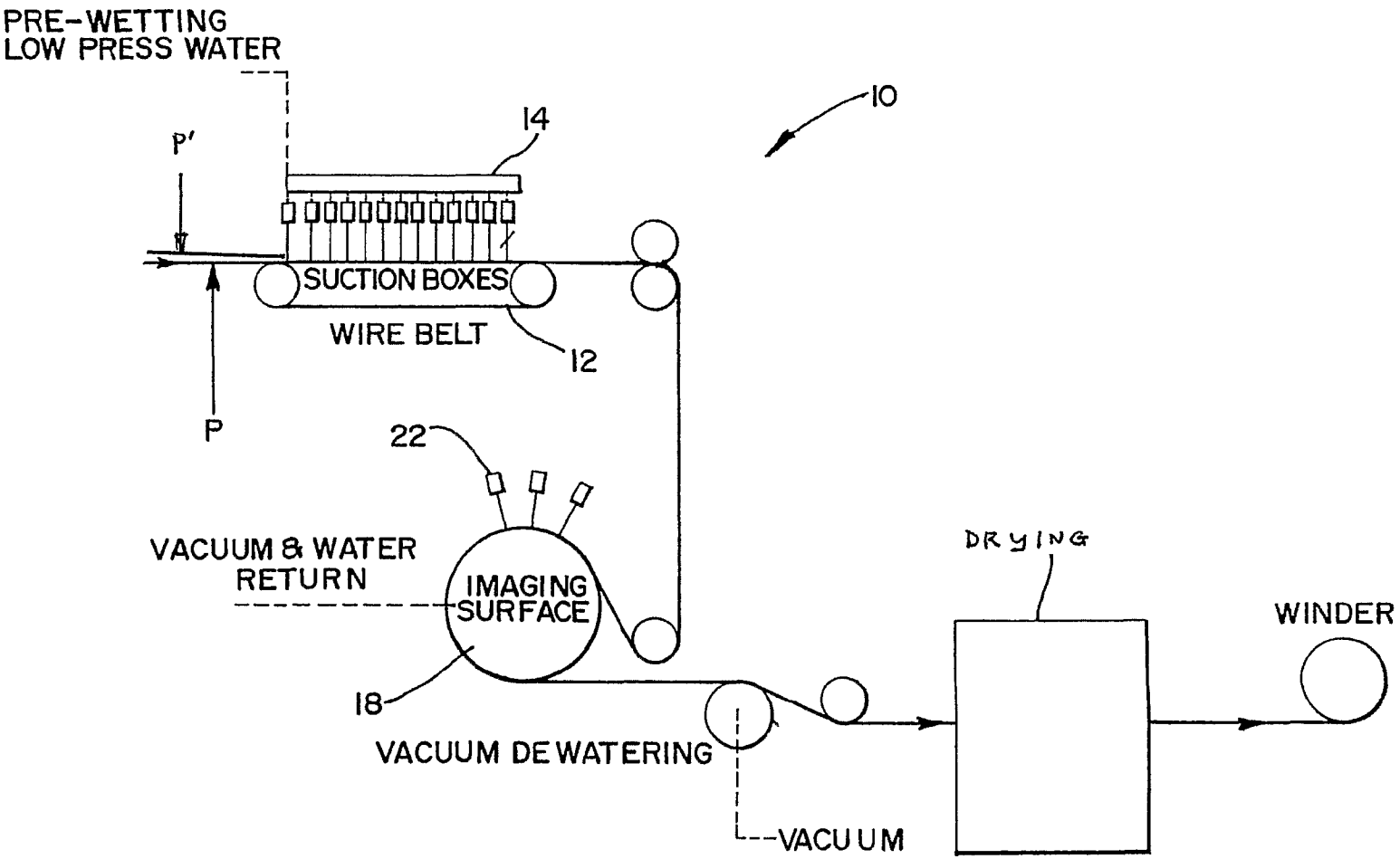
10
PRE-WETTING
LOW PRESS WATER
14
P'
SUCTION BOXES
12
WIRE BELT
P
22
VACUUM & WATER
RETURN
IMAGING
SURFACE
18
VACUUM DEWATERING
VACUUM
DRYING
WINDER

DURABLE FLAME-RETARDANT NONWOVEN FABRIC AND METHOD OF MAKING

This application is a National Stage Application of PCT/US2006/030897, filed Aug. 7, 2006, which claims the benefit of priority of U.S. Provisional Application No. 60/705,945, filed on Aug. 5, 2005, the disclosures of both of which are incorporated herein by reference.

TECHNICAL FIELD

The present invention generally relates to a durable fire retardant nonwoven fabric, and more specifically relates to a layered fire retardant fabric that performs in accordance with the requirements set forth in Technical Bulletin 603 of the State of California Department of Consumer Affairs (TB-603), wherein the fire retardant fabric includes at least two layers including at least one strength reinforcing layer that lends to the fabric integrity after flame exposure.

BACKGROUND OF THE INVENTION

More than thirty years ago, flammability standards were instituted by the Consumer Product Safety Commission under 16 C.F.R. §1632. These standards addressed the flammability requirements of mattresses to resist ignition upon exposure to smoldering cigarettes. However, the Code of Federal Regulations failed to address the need for mattresses to resist ignition upon exposure to small open flames, such as produced by matches, fighters, and candles.

Technological advances have proven to provide mattresses, as well as bedding constituents, with significantly better flammability protection. In light of these advancements, the California Legislature has mandated that the Consumer Product Safety Commission establish a revised set of standards that will ensure mattresses and bedding pass an open flame ignition test. Known as Assembly Bill 603 (AB 603), California Legislature has further mandated that the revised set of standards go into affect Jan. 1st of 2004.

Flame retardant staple fiber is known in the art. Further, flame retardant fiber has been utilized in the fabrication of nonwoven fabrics for bedding applications. Nonwoven fabrics are suitable for use in a wide variety of applications where the efficiency with which the fabrics can be manufactured provides a significant economic advantage for these fabrics versus traditional textiles. However, nonwoven fabrics have commonly been disadvantaged when fabric properties are compared, particularly in terms of surface abrasion, pilling, and durability in multiple-use applications. Hydroentangled fabrics have been developed with improved properties which are a result of the entanglement of the fibers or filaments in the fabric providing improved fabric integrity. Subsequent to entanglement, fabric durability can be further enhanced by the application of binder compositions and/or by thermal stabilization of the entangled fibrous matrix.

More recently, hydroentanglement techniques have been developed which impart raised profiled elements to nonwoven fabrics by embossing the fabric or by subjecting the fabric to hydraulic energy upon a foraminous surface, such as a wire screen, a metal perforated drum, a three-dimensional belt, or image transfer device. Exemplary foraminous surfaces are taught in U.S. Pat. No. 3,485,706 issued on Dec. 23, 1969 to inventor Evans, U.S. Pat. No. 6,324,738 issued on Nov. 16, 1999 to inventor Fleissner, U.S. Pat. No. 6,460,233 issued on Jan. 9, 2001 to inventor Noelle, and U.S. Pat. No. 5,098,764 issued on Mar. 24, 1992 to inventor Drelich, et al., all of which are hereby incorporated by reference as if set forth fully herein.

Heretofore, nonwoven fabrics have been advantageously employed for manufacture of flame retardant fabrics, as described in U.S. Pat. No. 6,489,256, issued Dec. 3, 2002 to inventor Kent, et al., which is hereby incorporated by reference. Typically, nonwoven fabrics employed for this type of application have been entangled and integrated by needle-punching, sometimes referred to as needle-felting, which entails insertion and withdrawal of barbed needles through a fibrous web structure. While this type of processing acts to integrate the fibrous structure and lend integrity thereto, the barbed needles inevitably shear large numbers of the constituent fibers, and undesirably create perforations in the fibrous structure. Needle-punching can also be detrimental to the strength of the resultant fabric, requiring that a fabric have a relatively high basis weight in order to exhibit sufficient strength.

In addition, nonwoven fire retardant fabrics have been produced for mattress components and bedding constituents that do not comply with the requirements asserted in Technical Bulletin 603 of the State of California Department of Consumer Affairs (TB-603). A need exists for a structurally stable nonwoven fabric that meets the requirements of TB-603 and suitable for various end-use applications including, but not limited to bedding constituents, such as mattress pads, mattress ticking, comforters, bedspreads, quilts, coverlets, duvets, pillow covers, as well as other home uses, protective apparel applications, upholstery, and industrial end-use applications.

SUMMARY OF THE INVENTION

The present invention is directed to a durable layered fire retardant fabric that performs in accordance with the requirements set forth in Technical Bulletin 603 of the State of California Department of Consumer Affairs (TB-603), wherein the fire retardant fabric includes at least two layers, including at least one strength reinforcing layer that lends to the fabric integrity after flame exposure.

In accordance with the present invention, the durable flame retardant fabric includes at least one reinforcing layer or scrim material. The reinforcing layer is typically either a cast scrim of synthetic polymers, cross-laid scrim, woven scrim, or combination thereof. Further, the reinforcing layer may include natural and synthetic polymeric materials, such as a polyolefins, including polypropylene and polyethylene, polyester, nylon, as well as cellulosic fiber, including cotton, rayon, lyocell or the like, and combinations or blends thereof. Fibers and filaments that lend to the fire retardant nature of the reinforcing material are also suitable for use in the present invention, as well as a blend of one or more fibers.

The reinforcing layer of the invention is combined with at least one and optionally more than one additional secondary layers. Suitable layers may include, but are not limited to wovens, nonwovens, films, and combinations thereof, wherein the layers may further include natural fibers, synthetic fibers, filament, fire retardant fiber or filaments, and combinations thereof. In one embodiment the second layer can be 50-100% cellulosic fiber, such as rayon, cotton, kenaf, Tencel® fiber, and combinations thereof, as well as include 0-50% synthetic fiber, such as polyester, nylon, polypropylene, aramid, melamine, polybenzimidazole, modacrylic, and combinations thereof. Tencel is a registered trademark of Lenzing Group.

In and of themselves, the fabric layers including fire retardant fibers are unable to perform in accordance with the requirements laid out in TB-603. It is within the purview of the present invention, to further treat the fire retardant layers with a fire retardant chemistry that additionally enhances the fire retardant performance of the fabric. A variety of suitable applications methods are known in the art, such as padding, spraying, submerging, and kiss coating. Further still, the two or more layers are consolidated by way of hydroentanglement, wherein hydraulic jets inter-engage the fibers of the reinforcing layer with the fiber of the one or more additional layers.

In accordance with the teachings of the present invention, a synergistic relationship exhibited between the reinforcing layer, fire retardant fiber, and fire retardant chemistry results in a hydroentangled fabric that is highly durable, complies with the requirements presented in TB-603, plus provides suitable tensile and tear strength characteristics as sought after for end use applications such as mattress components, mattress covers, upholstery panels, and the like.

Other features and advantages of the present invention will become readily apparent from the following detailed description, the accompanying drawings, and the appended claims.

BRIEF DESCRIPTION OF THE DRAWINGS

FIG. 1 is a diagrammatic view of a suitable apparatus for consolidating a flame retardant fabric in accordance with the present invention.

DETAILED DESCRIPTION

While the present invention is susceptible of embodiment in various forms, and will hereinafter be described, a presently preferred embodiment, with the understanding that the present disclosure is to be considered as an exemplification of the invention, and is not intended to limit the invention to the specific embodiment illustrated.

The durable fire retardant fabrics of the present invention performs in accordance with the requirements set forth in Technical Bulletin 603 of the State of California Department of Consumer Affairs (TB-603) and offers the desired stability, tensile, and tear strength suitable for applications, such as mattress components, particularly the bottom of pillow-top mattresses. Other end-uses that benefit from incorporating the fabric of the invention include, but are not limited to bedding constituents, such as mattress covers, comforters, bedspreads, quilts, coverlets, duvets, pillow covers, as well as other home uses, protective apparel applications, upholstery panels, and industrial end-use applications.

According to the present invention, the reinforcing layer acts as a facing layer, wherein the reinforcing layer may be a cast scrim, nonwoven, such as a carded layer or spunbond layer, woven substrate, and combinations thereof. Preferably, the reinforcing layer has a basis weight range from about 0.25 to 6.0 osy, more preferably a basis weight range from about 0.25 to 5.5 osy, and a most preferably a basis weight range from about 0.25 to 5.0 osy. Further, the reinforcing layer or scrim may include natural fiber, such as rayon, cotton, jute, kenaf, or Tencel® fiber, synthetic fiber, including, but not limited to polyolefins, polyesters, polyamides, and fire retardant fibers, including but not limited to aramids, such as meta and para aramid, polybenzimidazole (PBI), modacrylic, polylactic acid (PLA), and the combinations thereof.

In one embodiment, the reinforcing layer is a 2.0 osy 55% cotton, 45% polyester woven scrim combined with a carded secondary nonwoven layer, wherein the secondary nonwoven includes 16%-24% PLA and is about 8%-12% of the full fabric weight, with the one or more secondary layers having combined basis weight in the range of about 1.5 to 4 osy. The remaining fiber content of the one or more secondary layers may be selected from those fiber components identified above in connection with the reinforcing layer. Suitable fiber may further include mono-component and/or multi-component filament or fibers, such as side-by-side, sheath-core, islands in the sea, segmented pie, as well as copolymers and a combination thereof.

In accordance with the principles of the present invention, the fire retardant reinforcing layer is positioned in a face-to-face relationship with at least one additional layer or secondary layer and mechanically bonded by way of hydroentanglement. The hydroentanglement process is well known in the art and taught in U.S. Pat. No. 3,485,706 issued on Dec. 23, 1969 to inventor Evans, previously incorporated herein by reference. Additional layers may include various nonwovens, including air-laid, wet-laid, spunlace, spunbond, as well as fire retardant films, scrims, wovens, and combinations thereof. Woven substrates may include similar or dissimilar warp and weft fibers and numerous weave patterns that lend to the optimization of the fire retardant performance. Suitable layers typically have basis weights ranging from about 1.0 to 10 osy, more preferably from about 1.0 to 9.0 osy, and most preferably from 1.0 to 8.0 osy.

Turning to FIG. 1, therein is an illustrative embodiment of a hydroentangling apparatus suitable for consolidating the fire retardant fabric of the invention, whereby the apparatus includes a foraminous forming surface in the form of belt 12 upon which the precursor webs P and P' are positioned for entangling or pre-entangling by manifold 14. The entangling apparatus of FIG. 1 may optionally include, an imaging and patterning drum 18 for imparting raised potions into the reinforcing layer and/or one or more additional layers incorporated in the present invention. Suitable imaging and patterning drum 18 for affecting the lightly entangled precursor web include, but are not limited to three-dimensional image transfer devices, wire mesh screens, or embossed or perforated drums. Such exemplary devices are taught in U.S. Pat. No. 3,485,706 issued on Dec. 23, 1969 to inventor Evans, U.S. Pat. No. 6,324,738 issued on Nov. 16, 1999 to inventor Fleissner, U.S. Pat. No. 6,460,233 issued on Jan. 9, 2001 to inventor Noelle, and U.S. Pat. No. 5,098,764 issued on Mar. 24, 1992 to inventor Drelich, et al., previously incorporated herein by reference. The image and patterning drum 18 includes a moveable imaging surface which moves relative to a plurality of entangling manifolds 22 which act in cooperation with the raised elements defined by the foraminous surface of the device to effect imaging and patterning of the fabric being formed.

In further keeping with the principles with the present invention, subsequent to hydroentanglement the reinforcing layer, as well as the one or more additional layers, the fabric is treated with at least one fire retardant chemistry to further enhance the fire retardant performance. In one particular embodiment, the fire retardant chemistry includes an anti-foam (0.05-0.5%), a binder component (1.0-5%), such as Conpad Aux 2032, made commercially available by Consulmag Inc., a fire retardant component (15-50%), such as Glo Tard FFR-2, a commercial product of Glo Tex International, and a desired colorant, with the balance being water. The fire retardant chemistry may be applied by any one of the various applications techniques known in the art, such as spraying, padding, kiss-coating, and submerging. Optionally, the fire retardant fabric may be subjected to one or more post-treatments, including both mechanical and chemical post-treatments, such as binder and/or additive treatments for enhancing fabric aesthetic or physical attributes.

Testing results as set forth in Table 1, indicate the synergistic relationship between the reinforcing layer, fire retardant fibers, and fire retardant chemistry, as observed in accordance with the teachings of the present invention, provides for a fire retardant fabric compliant with the requirements set forth in Technical Bulletin 603 of the State of California Department of Consumer Affairs (TB-603) and further offers the desired stability, tensile, and tear strength desired for Mattress component end use applications.

From the foregoing, it will be observed that numerous modifications and variations can be affected without departing from the true spirit and scope of the novel concept of the present invention. It is to be understood that no limitation with respect to the specific embodiments illustrated herein is intended or should be inferred. The disclosure is intended to cover, by the appended claims, all such modifications as fall within the scope of the claims.

| | | M093x 70% Tencel ®/30% PET w/FR finish (based on latest run) | HH-580 f: 2 oz COT/Poly scrim b: 2.5 oz 70% Tencel ®/30% PET w/FR finish | HH-582 f: 2 oz COT scrim b: 2.5 oz 70% Tencel ®/30% PET w/FR finish |
|---|---|---|---|---|
| basis wt | oz/yd 2 | 4.77 | 5.4 | 5.3 |
| MD Tensile | lbs | 54 | 74 | 57 |
| CD Tensile | lbs | 72 | 54 | 29 |
| MD Elong | % | 52 | 17 | 16 |
| CD Elong | % | 40 | 19 | 25 |
| MD Tear | grams | 5120 | 1362 | 1159 |
| CD Tear | grams | 3162 | 2898 | 3838 |
| FR Barrier | % wt loss | 6.9 | 8.7 | 7.0 |

Comparison of FR

| Code | carded wt | carded blend1 name | % | carded blend2 name | % | carded blend3 name | % | finish: CF = chemical free, Stratus = FR | flame perf | COMMENT | Avg. Peek Heat |
|---|---|---|---|---|---|---|---|---|---|---|---|
| HH472A | 4.2 | K215 Tencel | 64 | T203 PET | 27 | Twaron | 9 | Stratus | 10.2 | | 669.3 |
| HH472B | 3.5 | K215 Tencel | 64 | T203 PET | 27 | Twaron | 9 | Stratus | 10.1 | | |
| HH472C | 4 | K215 Tencel | 60 | T203 PET | 25 | Twaron | 15 | Stratus | 10.6 | fails SIMS | |
| HH472D | 3.5 | K215 Tencel | 60 | T203 PET | 25 | Twaron SCRIM | 15 | Stratus | 13.2 | fails SIMS | 618 |
| HH574A | 2.5 | K215 Tencel | 65 | T203 PET | 10 | Twaron | 25 | Stratus | 6.5 | passes SIMS, $$ | 676.5 |
| HH574B | 2 | K215 Tencel | 65 | T203 PET | 10 | Twaron | 25 | Stratus | 7.5 | fails SIMS | 665.8 |
| HH580 | 2.5 | K215 Tencel | 70 | T203 PET | 30 | Twaron | 0 | Stratus | 7.3 | | 658.3 |
| HH585 | 2.1 | K215 Tencel | 30 | PBX MOD | 35 | Twaron | 35 | CF | 10.6 | | |
| HH588 | 2.5 | K215 Tencel | 70 | PLA | 20 | Twaron | 10 | CF | 13.5 | cracked | |
| HH588F | | | | | | | | Stratus | 9.2 | | 603 |
| HH588F | | | | | | | | New Stratus | 8.1 | | 783 |
| HH589 | 2.0 | K215 Tencel | 50 | Huifu MOD | 25 | Twaron | 25 | CF | 10.4 | | |
| HH589F | | | | | | | | Stratus | 9.0 | | |
| HH590 | 2.0 | K215 Tencel | 60 | T213 PET | 22.5 | Twaron | 17.5 | CF | 7.8 | | |
| HH590F | | | | | | | | Stratus | 8.7 | | 647 |
| HH590F | | | | | | | | New Stratus | 11.8 | | 664 |
| HH591 | 2.0 | K215 Tencel | 61 | PLA | 18 | Twaron | 21 | CF | 8.9 | cracked | |
| HH591F | | | | | | | | Stratus | 8.1 | | 693.3 |
| HH592 | 4.2 | Huifu MOD | 50 | T190 FR PET | 50 | Twaron | 0 | CF | failed | | |
| HH593 | 2.5 | Protex MOD | 80 | T213 PET | 20 | Twaron | 0 | CF | 8.1 | | |
| HH593F | | | | | | | | Stratus | failed | | |
| HH594 | 2.0 | K215 Tencel | 61 | T213 PET | 18 | Twaron | 21 | CF | | | |

-continued

Comparison of FR

| Code | carded wt | carded blend1 name | % | carded blend2 name | % | carded blend3 name | % | finish: CF = chemical free, Stratus = FR | flame perf | COMMENT | Avg. Peek Heat |
|---|---|---|---|---|---|---|---|---|---|---|---|
| HH594F | | | | | | | | Stratus | 8.3 | | 816.3 |
| HH595 | 2.8 | K215 Tencel | 70 | PLA | 20 | Twaron | 10 | Stratus | | | |
| HH595F | | | | | | | | new Stratus | 11.2 | | 684 |
| HH596F | 2.8 | K215 Tencel | 70 | T213 PET | 20 | Twaron | 10 | new Stratus | 10.3 | | 587 |

603 TEST revised Jun. 15, 2004

PROCEDURE

1) IGNITE BURNER
2) GAS FLOW (flame 4" high)
3) PLACE FABRIC TO TEST ON LOWER PART OF JIG (FACE DOWN)
4) PLACE FOAM (5"X5") ON TOP OF FABRIC
5) PLACE TOP PLATE ON JIG
6) TIGHTEN WING NUTS TO COMPRESS FOAM
7) PLACE JIG (WITH EXPOSED FACE TO FLAME) ON RING STAND
8) BURN FOR 240 SEC.
9) REMOVE FROM FLAME**use gloves due to hot surface

| 2 oz Hanes scrim | SAMPLE NR. | FABRIC WT | FABRIC + FOAM WT | F + F AFTER BURN | % WT LOSS |
|---|---|---|---|---|---|
| 2.75 oz 70% Ten, 20% PLA, 10% Tw | HH595 | 20% PSD | 117% wpu | | |
| | 050531-1 | 4.31 | 32.09 | 0 | 100.00 failed #DIV/0! |
| 2.8 70% Ten, 20% T213, 10% Tw | HH596 | | | | |
| | 050531-1 | 4.54 | 29.51 | 27 | 8.51 #DIV/0! |

What is claimed is:

1. A method of making a synthetic fiber-containing durable fire retardant fabric-containing material having only a hydroentangled fabric formed of one or more reinforcing layers and one or more additional secondary layers hydroentangled thereto, and a fire retardant binder composition applied to the hydroentangled fabric, comprising steps of:

providing one or more reinforcing layers, wherein said one or more reinforcing layers consist of polyester fibers and cellulosic fibers in combination;

positioning one or more additional secondary layers in a face-to-face relationship with the one or more reinforcing layers, wherein said one or more additional secondary layers consist of cellulosic fibers and synthetic fibers in combination, wherein said synthetic fibers are selected from the group consisting of polyester, nylon, polypropylene and combinations thereof;

hydroentangling the one or more reinforcing layers and the one or more additional secondary layers to produce a hydroentangled fabric formed of the one or more reinforcing layers and the one or more additional secondary layers hydroentangled thereto; and treating the hydroentangled fabric formed of the one or more reinforcing layers and the one or more additional secondary layers hydroentangled thereto with a fire-retardant binder composition to form a synthetic fiber-containing durable fire retardant fabric-containing material, wherein the synthetic fiber-containing durable fire retardant fabric-containing material performs in accordance with the requirements set forth in Technical Bulletin 603 of the State of California Department of Consumer Affairs.

2. The method of making the synthetic fiber-containing durable fire retardant fabric-containing material as in claim 1, wherein the one or more reinforcing layers are woven and the one or more additional secondary layers are nonwoven.

3. The method of making the synthetic fiber-containing durable fire retardant fabric-containing material as in claim 1, wherein the one or more reinforcing layers are nonwoven.

4. The method of making the synthetic fiber-containing durable fire retardant fabric-containing material as in claim 1, wherein the one or more additional secondary layers each comprises cellulosic fibers selected from the group consisting of rayon, cotton, jute, kenaf, lyocell fiber, and combinations thereof.

5. The method of making the synthetic fiber-containing durable fire retardant fabric-containing material as in claim 1, wherein the one or more reinforcing layers have a basis weight range from about 0.25 to 6.0 osy.

6. The method of making the synthetic fiber-containing durable fire retardant fabric-containing material as in claim 1, wherein the fire retardant binder composition is applied by spraying, padding, kiss-coating, submerging, and combinations thereof.

7. The method of making the synthetic fiber-containing durable fire retardant fabric-containing material as in claim 1, wherein the synthetic fiber-containing durable fire retardant fabric-containing material comprises raised elements.

8. The method of making the synthetic fiber-containing durable fire retardant fabric-containing material as in claim 1, wherein the fabric-containing material has a tensile strength of about 60 lbs and a tear strength of about 10 lbs.

9. A hydroentangled, synthetic fiber-containing durable fire-retardant fabric-containing material having only a hydroentangled fabric formed of one or more reinforcing layers and one or more additional secondary layers hydroentangled thereto, and a fire retardant binder composition applied to the hydroentangled fabric, said fabric-containing material comprising:

one or more reinforcing layers that consist of polyester fibers and cellulosic fibers in combination;

one or more additional secondary layers in a face-to-face relationship with the one or more reinforcing layers, wherein said one or more additional secondary layers consist of cellulosic fibers and synthetic fibers in combination, wherein said synthetic fibers are selected from the group consisting of polyester, nylon, polypropylene and combinations thereof, and wherein said one or more additional secondary layers are joined by hydroentanglement with said one or more reinforcing layers as a hydroentangled fabric;

a fire retardant binder composition applied to the hydroentangled fabric formed of the one or more reinforcing layers and the one or more additional secondary layers hydroentangled thereto, to provide a synthetic fiber-containing durable fire retardant fabric-containing material; and wherein the synthetic fiber-containing durable fire retardant fabric-containing material performs in accordance with the requirements set forth in Technical Bulletin 603 of the State of California Department of Consumer Affairs.

10. The hydroentangled, synthetic fiber-containing durable fire-retardant fabric-containing material as in claim 9, wherein said fabric material is configured as a bedding component.

11. The method of making the synthetic fiber-containing durable fire retardant fabric-containing material as in claim 1, wherein said one or more reinforcing layers comprise cellulosic fibers selected from the group consisting of rayon, cotton, jute, kenaf, and combinations thereof.

12. The hydroentangled synthetic fiber-containing durable fire retardant fabric-containing material as in claim 9, wherein said one or more reinforcing layers comprise cellulosic fibers that are selected from the group consisting of rayon, cotton, jute, kenaf, and combinations thereof.

13. The method of making the synthetic fiber-containing durable fire retardant fabric-containing material as in claim 1, wherein the one or more reinforcing layers are a woven scrim and the one or more additional secondary layers are nonwoven.

14. The hydroentangled synthetic fiber-containing durable fire retardant fabric-containing material in accordance with claim 9, wherein the one or more reinforcing layers are a woven and the one or more additional secondary layers are nonwoven.

15. The hydroentangled synthetic fiber-containing durable fire retardant fabric-containing material in accordance with claim 9, wherein the one or more reinforcing layers are a woven scrim and the one or more additional secondary layers are nonwoven.

16. The hydroentangled synthetic fiber-containing durable fire retardant fabric-containing material in accordance with claim 9, wherein said one or more additional secondary layer comprises cellulosic fibers that are selected from the group consisting of rayon, cotton, jute, kenaf, lyocell fiber, and combinations thereof, and the synthetic fibers are selected from the group consisting of nylon and polypropylene.

* * * * *